US007216689B2

(12) United States Patent
Verner et al.

(10) Patent No.: US 7,216,689 B2
(45) Date of Patent: May 15, 2007

(54) INVESTMENT CASTING

(75) Inventors: Carl R. Verner, Windsor, CT (US); James T. Beals, West Hartford, CT (US); Jacob A. Snyder, Southington, CT (US); Stephen D. Murray, Marlborough, CT (US); Michael T. Turkington, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 15 days.

(21) Appl. No.: 10/867,230

(22) Filed: Jun. 14, 2004

(65) Prior Publication Data

US 2005/0274478 A1 Dec. 15, 2005

(51) Int. Cl.
*B22C 7/00* (2006.01)

(52) U.S. Cl. ..... 164/45; 164/516

(58) Field of Classification Search ..... 164/45, 164/516, 235, 361, 369, 340, 397
See application file for complete search history.

(56) References Cited

U.S. PATENT DOCUMENTS

| | | | | |
|---|---|---|---|---|
| 4,160,313 | A * | 7/1979 | Radford | 29/525 |
| 4,283,835 | A | 8/1981 | Obrochta et al. | |
| 4,487,246 | A * | 12/1984 | Frasier | 164/32 |
| 5,291,654 | A * | 3/1994 | Judd et al. | 29/889.721 |
| 5,296,308 | A | 3/1994 | Caccavale et al. | |
| 5,405,242 | A | 4/1995 | Auxier et al. | |
| 5,640,767 | A | 6/1997 | Jackson et al. | |
| 5,853,044 | A | 12/1998 | Wheaton et al. | |
| 6,505,678 | B2 * | 1/2003 | Mertins | 164/516 |
| 6,530,416 | B1 | 3/2003 | Tiemann | |
| 6,637,500 | B2 * | 10/2003 | Shah et al. | 164/369 |
| 6,668,906 | B2 | 12/2003 | Burd | |
| 6,705,831 | B2 | 3/2004 | Draper | |
| 2004/0020629 | A1 | 2/2004 | Shah et al. | |
| 2005/0087319 | A1 * | 4/2005 | Beals et al. | 164/45 |

OTHER PUBLICATIONS

European Search Report for EP Patent Application No. 05253615.8.

* cited by examiner

*Primary Examiner*—Kuang Y. Lin
*Assistant Examiner*—I.-H. Lin
(74) *Attorney, Agent, or Firm*—Bachman & LaPointe, P.C.

(57) ABSTRACT

Pre-molding of wax or similar sacrificial material over one or more cores facilitates a subsequent molding over a core assembly. Individual cores or groups thereof may be pre-molded in a wax body. One or more such wax bodies may be assembled with other bodies and/or other cores to facilitate a main wax molding of such assembly.

26 Claims, 2 Drawing Sheets

INVESTMENT CASTING

BACKGROUND OF THE INVENTION

The invention relates to investment casting. More particularly, the invention relates to the forming of core-containing patterns for investment forming investment casting molds.

Investment casting is a commonly used technique for forming metallic components having complex geometries, especially hollow components, and is used in the fabrication of superalloy gas turbine engine components.

Gas turbine engines are widely used in aircraft propulsion, electric power generation, ship propulsion, and pumps. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is typically provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

A well developed field exists regarding the investment casting of internally-cooled turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. In a shelling process, a ceramic shell is formed around one or more such patterns in well known fashion. The wax may be removed such as by melting in an autoclave. The shell may be fired to harden the shell. This leaves a mold comprising the shell having one or more part-defining compartments which, in turn, contain the ceramic core(s) defining the cooling passages. Molten alloy may then be introduced to the mold to cast the part(s). Upon cooling and solidifying of the alloy, the shell and core may be mechanically and/or chemically removed from the molded part(s). The part(s) can then be machined and/or treated in one or more stages.

The ceramic cores themselves may be formed by molding a mixture of ceramic powder and binder material by injecting the mixture into hardened metal dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned co-pending U.S. Pat. No. 6,637,500 of Shah et al. discloses exemplary use of a ceramic and refractory metal core combination. Other configurations are possible. Generally, the ceramic core(s) provide the large internal features such as trunk passageways while the refractory metal core(s) provide finer features such as outlet passageways. Assembling the ceramic and refractory metal cores and maintaining their spatial relationship during wax overmolding presents numerous difficulties. A failure to maintain such relationship can produce potentially unsatisfactory part internal features. It may be difficult to assembly fine refractory metal cores to ceramic cores. Once assembled, it may be difficult to maintain alignment. The refractory metal cores may become damaged during handling or during assembly of the overmolding die. Assuring proper die assembly and release of the injected pattern may require die complexity (e.g., a large number of separate die parts and separate pull directions to accommodate the various RMCs). Accordingly, there remains room for further improvement in core assembly techniques.

SUMMARY OF THE INVENTION

One aspect of the invention involves a method for forming an investment casting pattern. A first material is molded at least partially over a first core. A second material is molded at least partially over the first material.

In various implementations, the second material may be molded at least partially over a second core. After the first molding in a first die, the first core and first material may be assembled to the second core. The assembly may be introduced to a second die in which the second molding occurs. The first core may comprise, in major weight part, one or more refractory metals. The second core may comprise, in major weight part, one or more ceramic materials. The first molding may include positioning the first core in a first die at least in part by contacting a surface of the first die with one or more portions of the first core, said one or more portions becoming essentially flush with a surface of the first material. The first molding may include positioning the first core in a first die at least in part by positioning one or more portions of the first core in a subcompartment of a first die so that the one or more portions project from a surface of the first material after the first molding. The first molding may includes positioning the first core in a first die at least in part by placing a pre formed piece of sacrificial material between a surface of the first die a surface of the first core.

There may be a third molding of a third material at least partially over an alternate second core and the second molding may be at least partially over the third material. The first material and first core and the third material and alternate second core may be assembled to a third core before the second molding. The first and alternate second cores may comprise, in major part, one or more refractory metals. The third core may comprise, in major part, one or more ceramic materials. The second molding may comprises positioning the third core in a die at least in part by contacting the die with a projection unitarily formed with a remainder of the third core. The first and second materials may comprise, in major part, one or more waxes. The first and second materials may essentially be of similar composition. The first molding may be performed in a first die. The first molding may provide the first material with means for guiding insertion of the first material and first core into a second die.

Another aspect of the invention involves a method for forming an investment casting mold. An investment casting pattern is formed as above. One or more coating layers are applied to the pattern. The first material and the second material are substantially removed to leave the first core within a shell formed by the coating layers. In various implementations, the method may be used to fabricate a gas turbine engine airfoil element mold.

Another aspect of the invention involves a method for investment casting. An investment casting mold is formed as above. Molten metal is introduced to the investment casting mold. The molten metal is permitted to solidify. The investment casting mold is destructively removed. The method may be used to fabricate a gas turbine engine component.

Another aspect of the invention involves a component for forming an investment casting pattern. A first wax material at least partially encases a first core. The first wax material includes means for guiding insertion of the first wax material and the first core into a pattern-forming die. The first wax material may include means for maintaining a target relative position between the first core and a second core.

Another aspect of the invention involves a die for forming an investment casting pattern. The die includes at least one means for registering at least one core to which molding material has been pre-applied. One or more surfaces define a molding material-receiving space. A passageway is provided for introducing molding material to the molding material-receiving space.

In various implementations, the at least one means may further serve as means for guiding insertion of the at least one core to the die. The at least one means may include first means for registering a first such core and second means for registering a second such core. The first and second means may be formed on a single section of the die. The first and second means may be formed on respective first and second sections of the die.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
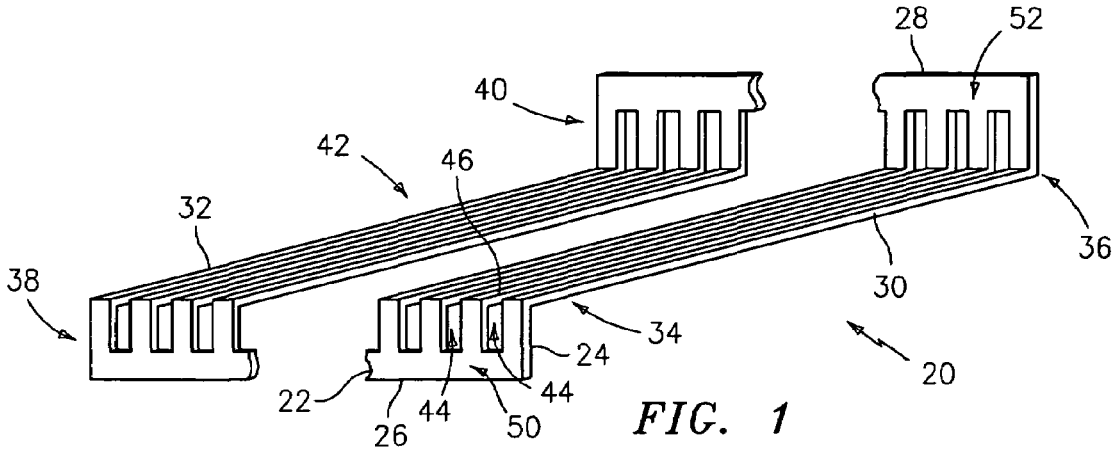
FIG. 1 is a view of a refractory metal core.

FIG. 1 shows an exemplary refractory metal core (RMC) 20 which may be formed by stamping and bending a refractory metal sheet and then coating the stamped/bent sheet with a full ceramic coating. The exemplary RMC 20 is intended to be illustrative of one possible general configuration. Other configurations, including simpler and more complex configurations are possible. The exemplary RMC 20 has first and second principal side surfaces or faces 22 and 24 formed from faces of the original sheetstock. After the exemplary stamping/bending process, the RMC extends between first and second ends 26 and 28 and has first and second lateral edges 30 and 32 therebetween. First and second bends 34 and 36 divide first and second end sections 38 and 40 from a central body section 42. In the exemplary implementation, the end sections and central body sections are generally flat with the end sections at an approximate right angle to the body section.

The exemplary stamping process removes material to define a series of voids 44 separating a series of fine features 46. The fine features 46 will form internal passageways in the ultimate cast part. In the exemplary embodiment, the fine features 46 are formed as an array of narrow strips extending along the entirety of the body section 42 and adjacent portions of the end sections 38 and 40. Such strips may form a series of narrow parallel passageways through the wall of a cast airfoil. Intact distal portions 50 and 52 of the end sections 38 and 40 connect the strips to maintain their relative alignment. Additionally, the strips may be connected at one or more intervening locations by connecting portions (not shown) for further structural integrity or to enhance fluid (e.g., cooling air) flow through the ultimate passageways. In an exemplary casting process, the RMC is positioned with portion 50 embedded in a slot or other mating feature of a ceramic core and portion 52 protruding entirely out of the wax of the investment casting pattern. The portion 52 may thus be embedded in a shell formed over the pattern. When the wax is removed and metal cast in the shell, and the ceramic core(s) and refractory metal core(s) are removed, the strips 46 will form passageways through a wall of the casting from an internal passageway previously defined by the ceramic core to an exterior surface previously defined by the shell.

Figure 2:
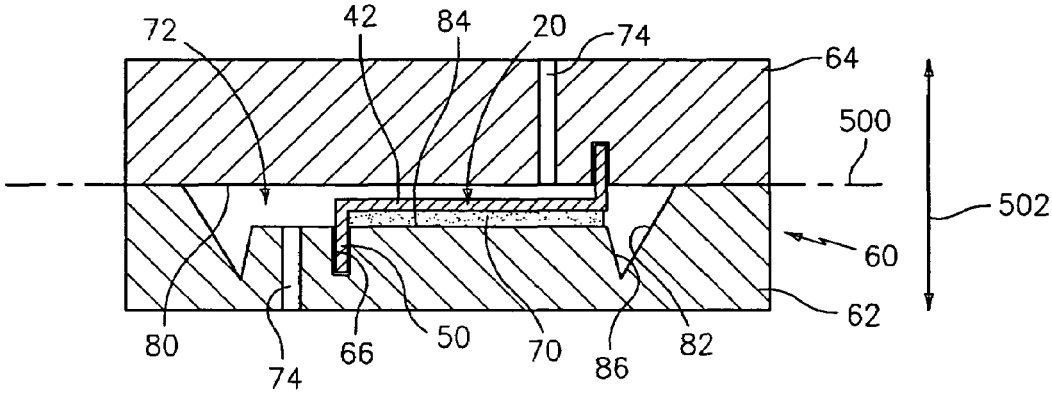
FIG. 2 is a sectional view of a die for pre-applying wax to the core of FIG. 1.

FIG. 2 shows the core 20 positioned within a wax pre-molding die 60 having first and second halves 62 and 64. The exemplary die halves are formed of metal or of a composite (e.g., epoxy-based). The exemplary die halves are shown assembled, meeting along a parting junction 500. Initially, with the die halves separate, the RMC 20 may be pre-positioned relative to one of the halves. For example, the portion 50 may be positioned in a slot 66 in the first half 62. If the RMC is sufficiently rigid, this interaction alone may hold the RMC in a desired alignment. Alternatively, the RMC may be further supported directly by the die half 62 or by one or more wax pads 70 pre-positioned in the die half 62 or pre-secured to the RMC. In the exemplary implementation, a pad 70 holds the body section 42 in a predetermined alignment and spacing from adjacent surface portions of the die halves. The assembled dies define a void 72 for injection (through die passageways 74) with wax to pre-mold over the RMC. The second die half has a surface 80 along the parting junction 500 at least partially shaped to correspond to the shape of a ceramic core to which the RMC 20 is to be assembled. Locally, this surface is spaced apart from the body 20 by the desired spacing between the ceramic core and RMC body. The first die half 62 has a surface 82 forming an exterior lateral perimeter of the void. The first die half 62 further includes a surface 84 in which the slot 66 is located and which is positioned relative to the body 20 so that the wax therebetween (e.g., the pad 70 or other injected wax) corresponds to the desired wall shape and thickness of the part. The surface 82 has a depth beyond the surface 84 and is joined thereto by an interior lateral perimeter surface 86. The surfaces 82 and 86 are angled to permit release of the overmolded wax from the first die half 62 after such wax is injected into the void and solidified. FIG. 2 further shows a pull or joining/parting axis 502. It is along this axis that the die halves are translated together and apart respectively before and after the injection of wax. In the exemplary embodiment, the RMC with the pre-molded wax may be extracted from the first die half 62 along this same axis. In alternative embodiments, this extraction may be off-parallel to the pull axis 502. The angling of the surfaces 82 and 86 relative to this extraction direction are chosen to prevent backlocking of the injected part. As is discussed in further detail below, the angling of the surface 82 is advantageous to facilitate a second wax application stage.

Figure 3:
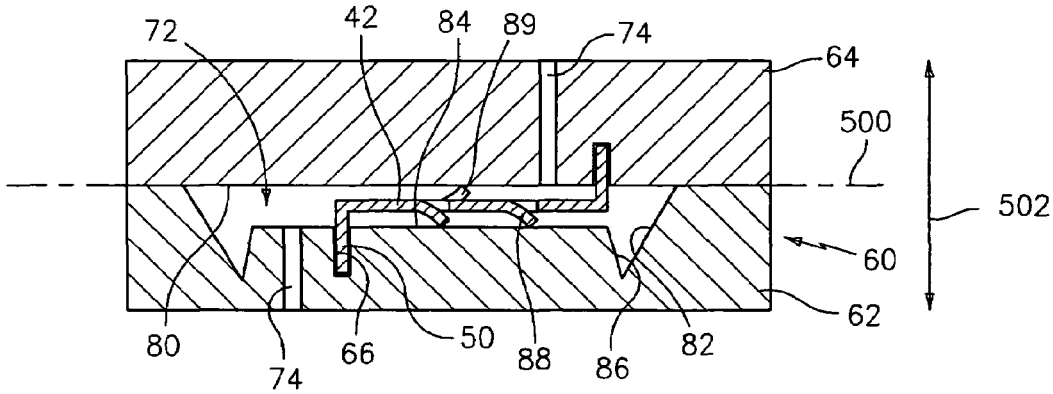
FIG. 3 is a sectional view of the die of FIG. 2 with an alternate refractory metal core.

As an alternative to use of the pad 70, or in addition thereto, the RMC may include one or more support projections 88 and 89 (FIG. 3). These may be tab-like projections tangs with distal portions bent away from adjacent material of the RMC or may take other forms. After wax molding, the tips of the projections may be essentially flush to the surface of the molded wax (i.e., not projecting/protruding and not subflush). After ultimate casting, the projections may leave small holes either to the part exterior surface or interior surface, depending upon their location in view of the particular die orientation. Many configurations are possible. In the orientation of FIG. 3, the one or more depending projections 88 help support the RMC. One or more at least partially oppositely directed upwardly extending projections 89 may serve to further retain the RMC (e.g., against movement due to die vibration or die orientation changes).

Figure 4:
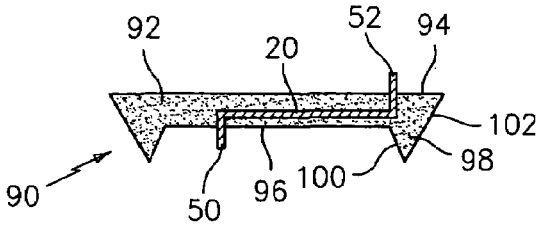
FIG. 4 is a sectional view of a core with pre-applied wax.

FIG. 4 shows the pre-molded RMC 90 including the RMC 20 and the pre-molding wax body 92 alter release from the die 60. The pre-molding wax has a first surface 94 generally formed by the surface 80 of the second die 64 and from which the end portion 52 protrudes. Opposite the surface 94, the wax body 92 has a central surface 96 associated with the surface 84 of the first die 62 and from which the first end portion 50 protrudes. The surface 96 is surrounded by a wall portion 98 protrading therebeyond and having an inner perimeter surface 100 molded byte surface 86 of the first die 62 and an outer perimeter surface 102 molded byte surface 82 of the first die 62.

Figure 5:
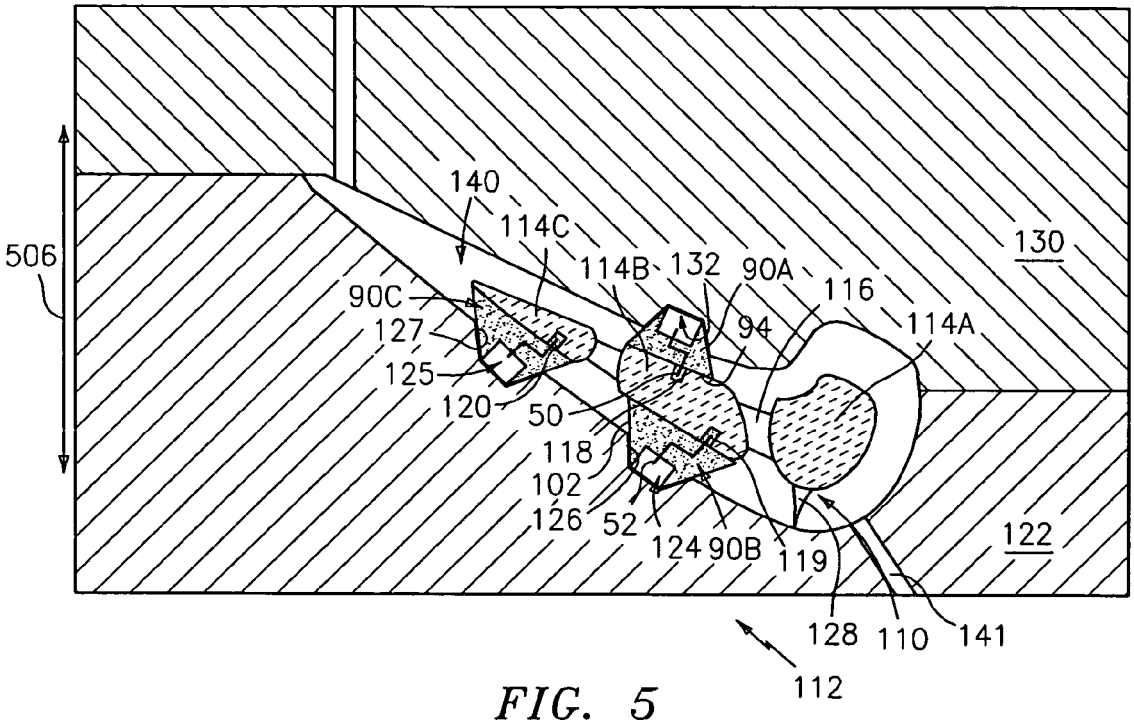
FIG. 5 is a sectional view of a die for overmolding a core assembly including cores with pre-applied wax.

FIG. 5 shows three pre-molded cores 90A, 90B, and 90C secured to a ceramic core 110 within a pattern die 112 in which the second wax application stage occurs. The second stage may be a main stage in which the additional wax molded over the ceramic core and pre-molded cores constitutes a majority of the total wax of the ultimate pattern. Alternatively, the additional wax may at least be of greater amount (e.g., volume) than the wax of any of the individual pre-molds. Yet alternatively, and largely influenced by the arrangement of the cores, the additional wax may be a lesser amount.

The exemplary ceramic core 110 is shown configured to form an airfoil element (e.g., a blade or vane of a gas turbine engine turbine section) and has leading, intermediate, and trailing sections 114A, 114B, and 114C for forming corresponding main passageways and connected by a series of webs 116 for core structural integrity. In the exemplary embodiment, the first pre-molded core 90A is mounted to a pressure side surface of the intermediate core section 114B; the second pre-molded core 90B is mounted to a suction side surface thereof; and the third pre-molded core 90C is mounted to a suction side surface of the trailing core section 114C. The distal portions 50 of the pre-molded RMCs 90A, 90B, and 90C are accommodated within slots 118, 119, and 120 in the associated surface of the associated ceramic core sections. These distal portions 50 may be secured in place via ceramic adhesive in the slots. Additionally, or alternatively, the surfaces 94 of the first and second pre-molded RMCs may be wax welded or otherwise adhered to the adjacent ceramic core surface. Various additional RMCs (not shown) may be secured to the ceramic core in a similar fashion or otherwise. The core assembly may then be placed in one of the die halves (e.g., a first half 122), with the protruding portions of the wall 98 of the second and third pre-molded cores 90B and 90C and their second distal portions 52 accommodated within compartments 124 and 125. Interaction of the surfaces 102 of such pre-molded cores with the surfaces 126 and 127 of the compartments may help guide insertion of the core assembly into the die half 122 and locate and register the core assembly once inserted. Insertion may be along an axis 506. Alternatively or additionally, the core assembly may be registered by direct contact between the ceramic core and the die half (e.g., at ends (not shown) of the ceramic core which ends ultimately protrude from the pattern and do not form internal features of the cast part). Similarly, the ceramic core may have additional positioning or retention features such as projections 128 unitarily or otherwise integrally formed with the feed portions of the ceramic core. Possible such projections are shown in U.S. Pat. No. 5,296,308 of Caccavale et al.

The die upper half 130 may then be mated with the lower half 122, with the first pre-molded core 90A being accommodated within a compartment 132 in similar fashion to the accommodation of the second and third pre-molded cores 90B and 90C. Mating of the die halves (and their ultimate separation) may also be along the axis 506 or may be along an axis at an angle thereto. In the assembled view of FIG. 5 it can be seen how the angling of the perimeter surfaces of the pre-molded RMCs may facilitate joining and parting of the die halves 122 and 130 without destroying the pre-molded RMCs. The angling is sufficient to prevent back-locking when the die halves are separated and when the pattern is extracted. In the illustrated embodiment, it can be seen how the end portions 52 can extend at an angle to the axis 506. This is permitted because the walls 98 or other surrounding pre-molding structure preclude the need for the die halves to closely accommodate the portions 52. If the die halves closely accommodated the portions 52, the portions 52 would have to be oriented parallel to the axis 506 to permit assembly/disassembly of the die halves and/or installation or removal of the pattern. In alternative embodiments, one or more of the pre-molded cores may be assembled first to an associated mold half and then to the ceramic core as the ceramic core is put in place or as the die halves are joined. In yet alternative embodiments, the compartment for a pre-molded RMC may span two die halves.

Figure 6:
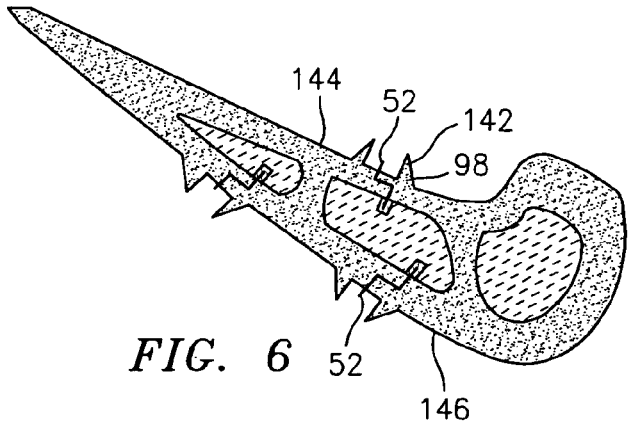
FIG. 6 is a sectional view of an airfoil of a pattern precursor molded in the die of FIG. 5.
Figure 7:
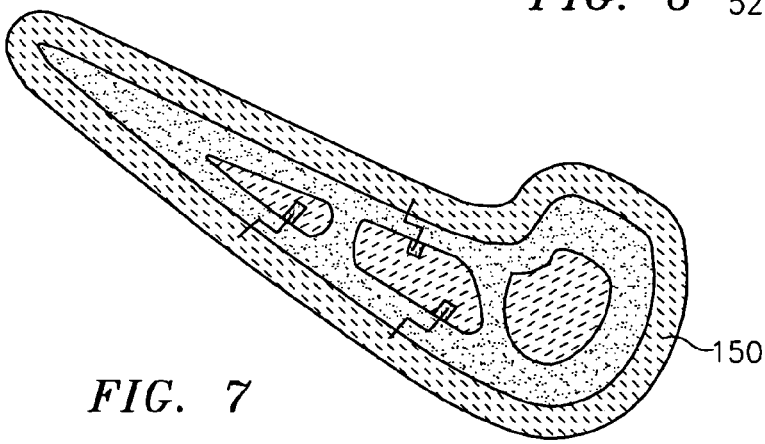
FIG. 7 is a sectional view of a shelled pattern from the precursor of FIG. 6.

After injection of the additional (main) wax into the space 140 surrounding the core assembly (through injection passageways 141 in the die halves) and solidification of such wax, the die halves are parted and the molded core assembly removed. Removal may be via an extraction along the axis 506 or potentially along an alternate axis at an angle thereto. FIG. 6 shows the molded core assembly after removal, with tip portions 142 of the walls 98 protruding from pressure and suction side surfaces 144 and 146 of the pattern airfoil contour. These protruding portions may be cut off or otherwise removed leaving a smooth pattern surface contour from which the RMC second distal portions 52 protrude. By forming the walls 98 as structure surrounding the distal portion 52 but with protruding portions spaced apart therefrom and leaving a surrounding volume (e.g., as opposed to embedding the end 52 in a plateau) only a relatively small amount of material needs to be removed and can be removed easily without producing unacceptable irregularities in the surface contour of the resulting pattern. The wall also helps keep the distal portion clean for good subsequent adhesion to the shell. As more material is required to be removed, it becomes more difficult to remove such material while preserving a desired contour. After such removal, the pattern may be assembled to a shelling fixture (e.g., via wax welding between upper and lower end plates of the fixture) and a multilayer coating 150 (FIG. 7) applied for forming a shell. After the coating dries, a dewax process (e.g., in a steam autoclave) may remove the wax from the pattern (e.g., both the pre-molding wax and the main molding wax) leaving the RMCs and ceramic core within the shell. This core and shell assembly may be fired to harden the shell. Molten metal may then be introduced to the shell to fill the spaces between the core assembly and the shell. After solidification, the shell may be destructively removed (e.g., broken away via an impact apparatus) and the core assembly destructively removed (e.g., via a chemical immersion apparatus) from the cast metal to form a part precursor. Thereafter, the precursor may be subject to machining, treatment (e.g., thermal, mechanical, or chemical), and coating (e.g., ceramic heat resistant coating) to form the ultimate component.

The foregoing teachings may be implemented in the manufacturing of pre-existing patterns (core combinations and wax shapes) or in to produce yet novel patterns. Whereas an existing single-stage molding process, may be relatively complex (e.g., having a large number of separate die parts and separate pull directions to accommodate the various RMCs), the main stage of a revised process may be simplified (e.g., having fewer die parts and fewer single pulls, with as few as two and one, respectively). This may simplify engineering and/or manufacturing.

One or more embodiments of the present invention have been described. Nevertheless, it will be understood that various modifications may be made without departing from the spirit and scope of the invention. For example, details of the particular components being manufactured will influence or dictate details of any particular implementation. Thus, other core combinations may be used, including small and/or finely-featured ceramic or other cores in place of the RMCs. Dies having more than two parts may be used at either the pre-molding or the second molding stage. However, one potential advantage of the invention is in limiting the required die complexity for forming a given pattern. Accordingly, other embodiments are within the scope of the following claims.

What is claimed is:

1. A method for forming an investment casting pattern comprising:

a first molding of a first body at least partially over a first core;

assembling the first body to a second core; and a second molding of a second body at least partially over the first body and second core.

2. The method of claim 1 wherein:

the first molding is in a first die and the second molding is in a second die.

3. The method of claim 2 wherein:

said first core comprises, in major part, one or more refractory metals; and said second core comprises, in major part, one or more ceramic materials.

4. The method of claim 1 wherein:

the first and second bodies are wax; and the second molding provides a majority of a combined wax amount of the first and second moldings.

5. The method of claim 1 wherein the first molding includes:

positioning the first core in a first die by contacting a surface of the first die with one or more portions of the first core, said one or more portions becoming essentially flush with a surface of the first body.

6. The method of claim 1 wherein the first molding includes:

positioning the first core in a first die by positioning one or more portions of the first core in a subcompartment of a first die so that the one or mom portions project from a surface of the first body alter the first molding.

7. The method of claim 1 wherein the first molding includes:

positioning the first core in a first die by placing a pre-formed piece of sacrificial material between a surface of the first die and a surface of the first core.

8. The method of claim 1 further comprising a third molding of a third body at least partially over a third core and wherein:

said second molding is at least partially over said third body.

9. The method of claim 8 wherein:

the first body and the third body are assembled to the second core before the second molding.

10. The method of claim 9 wherein:

the first and third cores comprise, in major part, one or more refractory metals; and the second core comprises, in major part, one or more ceramic materials.

11. The method of claim 10 wherein:

the second molding comprises positioning the second core in a die at least in part by contacting the die with a projection unitarily formed with a remainder of the second core.

12. The method of claim 1 wherein:

the first end second bodies comprise, in major part, one or more waxes.

13. The method of claim 1 wherein:

the first and second bodies are essentially of similar composition.

14. The method of claim 1 wherein:

said first molding is performed in a first die; and said first molding provides said first body with means for guiding insertion of the first body and first core into a second die.

15. A method for forming an investment casting mold comprising:

forming an investment casting pattern as in claim 1;

applying one or more coating layers to said pattern; and substantially removing the first body and the second body to leave the first core within a shell formed by the coating layers.

16. The method of claim 15 used to fabricate a gas turbine engine airfoil element mold.

17. A method for investment casting comprising:

forming an investment casting mold as in claim 15;

introducing molten metal to the investment casting mold;

permitting the molten metal to solidity; and destructively removing the investment casting mold.

18. The method of claim 17 used to fabricate a gas turbine engine component.

19. The method of claim 1 wherein:

the first molding includes positioning the first core in a first die by contacting a surface of the first die with one or more portions of the first core, said one or more portions becoming essentially flush with a surface of the first body; and said second molding includes positioning the first body and second core in a second die.

20. The method of claim 1 wherein:

the first molding is performed in a first die; and the second molding is performed in a second die.

21. The method of claim 1 wherein:

the first and second moldings comprise injection of wax.

22. A method for forming an investment casting pattern comprising:

a first molding of a first body a least partially over a first core including positioning the first core in a first die by placing a pre-formed piece of sacrificial material between a surface of the first die and a surface of the first core; and a second molding of a second body at least partially over the first body.

23. The method of claim 22 wherein:

the first molding is performed in a first die; and the second molding is performed in a second die.

24. The method of claim 22 wherein:

the first and second bodies are wax; and the second molding provides a majority of a combined wax amount of the first and second moldings.

25. A method for forming an investment casting pattern comprising:

a first molding of a first body at least partially over a first core; and a second molding of a second body at least partially aver the first body, wherein said first molding is performed in a first die; and said first molding provides said first body with means for guiding insertion of the first body and first core into a second die.

26. The method of claim 25 wherein:

the second molding is performed in said second die.

* * * * *

UNITED STATES PATENT AND TRADEMARK OFFICE

CERTIFICATE OF CORRECTION

PATENT NO. : 7,216,689 B2
APPLICATION NO. : 10/867230
DATED : May 15, 2007
INVENTOR(S) : Carl R. Verner et al.

It is certified that error appears in the above-identified patent and that said Letters Patent is hereby corrected as shown below:

In column 8, claim 6, line 1, delete “mom” and insert --more--.

In column 8, claim 12, line 27, delete “end” and insert --and--.

In column 8, claim 17, line 49, delete “solidity” and insert --solidify--.

In column 10, claim 25, line 5, delete “aver” and insert --over--.

Signed and Sealed this

Eighteenth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,216,689 B2
APPLICATION NO. : 10/867230
DATED : May 15, 2007
INVENTOR(S) : Carl R. Verner et al.

It is certified that error appears in the above-identified patent and that said Letters Patent is hereby corrected as shown below:

On the Title page, the fifth inventor, please change "Michael T. Turkington" to read --Michael K. Turkington--.

Signed and Sealed this

Twenty-fifth Day of November, 2008

JON W. DUDAS
*Director of the United States Patent and Trademark Office*